United States Patent [19]

Pike et al.

[11] Patent Number: 4,979,588

[45] Date of Patent: Dec. 25, 1990

[54] OVERHEAD IMPACT SENSING SYSTEM

[75] Inventors: Ronald L. Pike, Waynesboro; Ronald W. Beckley, State Line; Donald C. Hade, Jr., Waynesboro; Robert D. Backer, Rouzerville, all of Pa.

[73] Assignee: Kidde Industries, Inc., Iselin, N.J.

[21] Appl. No.: 478,401

[22] Filed: Feb. 12, 1990

[51] Int. Cl.[5] ..... B66F 11/04

[52] U.S. Cl. ..... 182/18; 182/19; 182/2; 212/149; 212/151

[58] Field of Search ..... 182/2, 19, 63, 141, 182/129, 18; 212/151, 149

[56] References Cited

U.S. PATENT DOCUMENTS

| | | | |
|---|---|---|---|
| 2,815,250 | 12/1957 | Trump | 182/2 |
| 2,979,152 | 4/1961 | Eitel | 182/19 |
| 3,638,758 | 2/1972 | Weisker | 182/112 |
| 3,670,849 | 6/1972 | Milner | 182/19 |
| 4,064,997 | 12/1977 | Holland | 212/151 |
| 4,456,093 | 6/1984 | Finley | 182/19 |
| 4,690,246 | 9/1987 | Hornagold | 182/19 |

*Primary Examiner*—Reinaldo P. Machado
*Attorney, Agent, or Firm*—Brady, O'Boyle & Gates

[57] ABSTRACT

An electrical deactivation circuit and a two piece overhead guard assembly including two separately movable bar members which extends upward and over the head of an operator located on the upper work platform of an aerial work platform. The guard bar members are connected to the frame of the upper work platform by a pair of movable support assemblies, the movement of which actuates impact detection induction type proximity switch means to interrupt electrical power applied to the electrical control circuits and stop the engine powering the aerial work platform. Each movable support assembly includes a pair of spring loaded mechanical subassemblies including a pair of clamp members between which is located an elongated coil spring whose stiffness is varied in accordance with the distance separation of the clamps. An inductive type proximity switch is located in the lower end portion of each spring to sense movement of the inner end of a respective guard bar member. Each proximity switch is connected in an electrial circuit having a built in time delay or lock out feature for applying power to the aerial work platform after a predetermined time delay and thereafter interrupting power when either guard bar member strikes or comes into contact with an external object or obstruction.

20 Claims, 5 Drawing Sheets

OVERHEAD IMPACT SENSING SYSTEM

BACKGROUND OF THE INVENTION

This invention relates generally to electrical control systems and more particularly to an electrical system for stopping the engine and removing power from all electrical control circuits of an aerial work platform due to the upper work platform or basket coming into dangerously close proximity to an overhead obstruction.

Systems responsive to obstructions for disabling various types of apparatus including aerial work platforms are generally known. Such apparatus typically includes some type of sensor which when it comes into contact with the obstruction, automatically disables the power circuit to the devices which move the platform. Such apparatus is disclosed, for example, in U.S. Pat. No. 3,670,849, entitled, "Aerial Personnel Platform With Proximity Sensing System", which issued to E. Milner, Jr. on June 20, 1972. There inflatable tubes operate to actuate an electrical switch to open the power circuit of a boom structure when the basket strikes an obstruction.

Overhead guards in combination with the platform are also known. Such devices are shown and described, for example, in U.S. Pat. No. 2,815,250, entitled, "Machine With Elevatable and Traveling Carriage", issued to W. E. Thornton-Trump on Dec. 3, 1957, and U.S. Pat. No. 3,638,758, entitled, "Overhead Guard", issued to A. Weisker on Feb. 1, 1972. In U.S. Pat. No. 2,815,250, there is disclosed a vertical element which projects over the top of the railing of the work platform and operates such that if the platform is raised too high so as to pin the operator between an overhead obstruction and the platform, the operator's body is pressed down on the vertical element to actuate means for moving the platform downward. In U.S. Pat. No. 3,638,758, an overhead guard is utilized in conjunction with a safety seat switch so that an operator must be seated when the overhead guard is in place over the operator to avoid the possibility of the operator contacting any overhead structure. The switch, however, is not actuated by the overhead guard.

Accordingly, it is an object of the present invention to provide an improvement in aerial work platforms.

It is another object of the invention to provide an electrical control circuit for disabling the work platform when the work platform comes in close proximity to an overhead obstruction.

It is yet another object of the invention to provide an electrical control circuit which operates in response to the sensing of an overhead obstruction to automatically disable the apparatus and thus remove the possibility of injury to an operator located on the upper work platform or control box thereof.

Still a further object of the invention is to disable the engine and remove power from the electrical control circuits of an aerial work platform in response to overhead impact sensing apparatus located on the upper work platform or control box striking or contacting an external object or obstruction.

SUMMARY

Briefly, the foregoing and other objects are achieved by the combination of an electrical deactivation circuit and a two piece overhead guard assembly including two separately movable bar members which extends upward and over the head of an operator located on the upper control box of an aerial work platform. The guard bar members are connected to the frame of the upper control box by a pair of movable support means, the movement of which actuates impact detection inductive proximity switch means to interrupt electrical power applied to the electrical control circuits and stop the engine powering the aerial work platform. Each movable support means comprises a pair of spring loaded mechanical assemblies comprised of a pair of clamp members and between which is located an elongated coil spring whose stiffness is varied in accordance with the distance separation of the clamps. An inductive type proximity switch is located in the lower end portion of each spring to sense movement of the inner end of a respective guard bar member. Each proximity switch is connected in an electrical circuit arrangement having a built in time delay or lock out feature for applying power to the aerial work platform after a predetermined time delay and thereafter interrupting power when either guard bar member strikes or comes into contact with an external object or obstruction.

BRIEF DESCRIPTION OF THE DRAWINGS

This invention will be more readily understood when the following detailed description is considered, together with the accompanying drawings wherein.

DETAILED DESCRIPTION OF THE INVENTION

Figure 1:
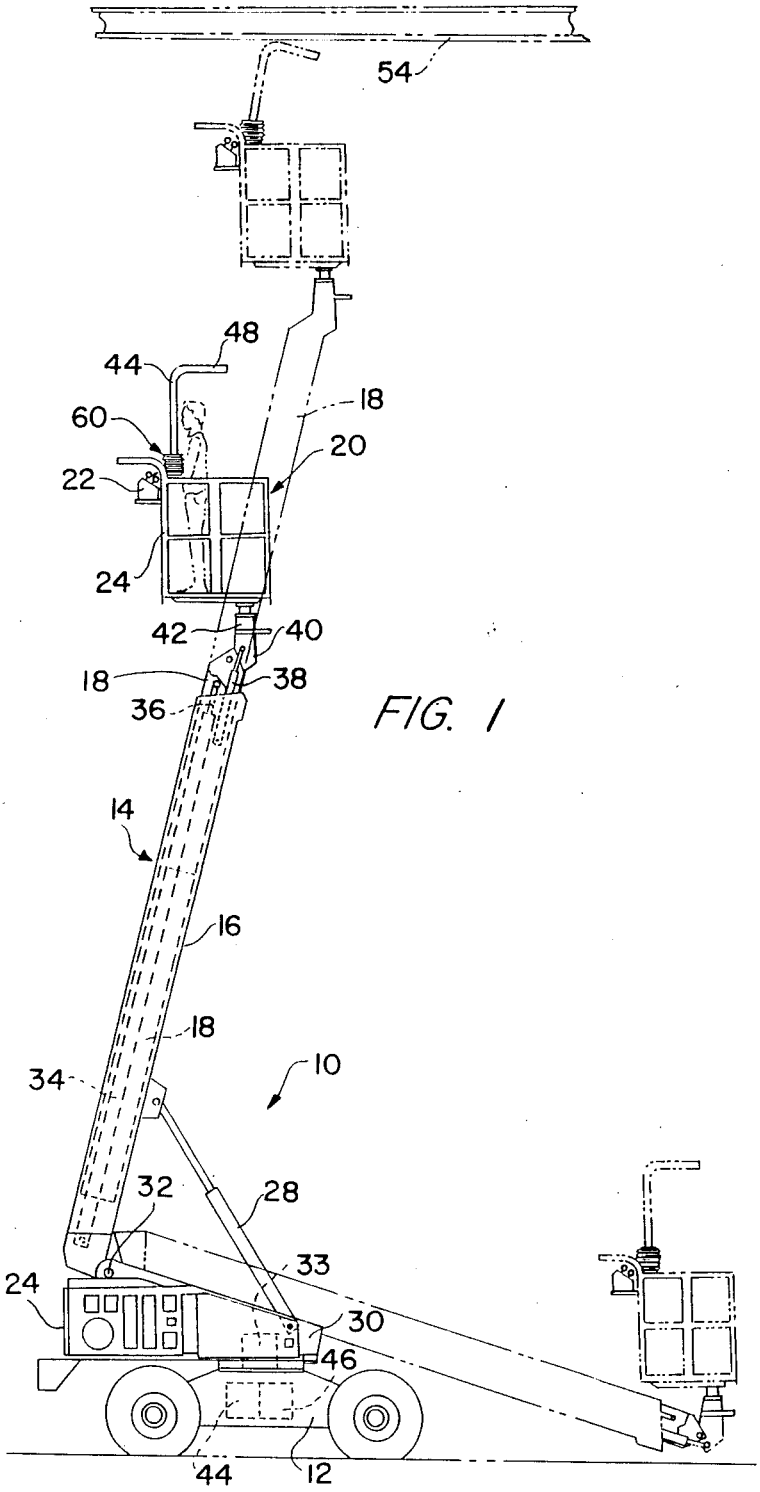
FIG. 1 is a side elevational view of an aerial work platform incorporating the subject invention.

Referring now to the drawings, reference is first made to FIG. 1 wherein there is shown an aerial work platform machine 10 comprised of a wheeled carriage 12 supporting a telescoping boom structure 14 including a pair of telescoping boom sections, namely, an outer section 16 and an inner section 18, with a work platform in the form of an upper work platform or control box 20 being mounted on the outer end of the inner section 18. A control panel 22 is attached to the frame or railing 24 of the upper control box so as to permit an operator stationed in the upper control box 20 to control all vehicle and upper control box motion including not only boom elevation and extension, but also is able to start and stop the engine 24 as well as control the steered movement of the carriage 12 itself.

The boom structure 14 is shown in FIG. 1 in an elevated position; however, two phantom views also depict the boom in a lowered position with the inner section 18 retracted as well as an elevated position, with the inner section extended. A hydraulic boom lift cylinder 28, moreover, is connected between a turntable superstructure member 30 and the outer boom section 16 and is controllable from the control panel 22 to elevate and lower the boom 14 about its pivot connection 32 with the turntable superstructure 30 as required during a work operation. Also, the turntable superstructure member 30 can be rotated by a motor and gearing 33 relative to the carriage 12 from the control panel 22, to thus rotate the boom structure.

A power cylinder 34 connected with outer section 16 and including a piston rod member 36 connected to the inner boom section 18 controls the telescoping extension of the inner section 18 and is also controlled from the control panel 22. A relatively small power cylinder 38, located in the far or distal end of the inner section 18, moreover, is coupled between the inner section 18 and a platform support bracket 40 that is pivoted to the end of inner section 18, and cylinder 38 operates from the control panel 22 to level the upper control box 20 as it is moved. At the upper end of the support bracket is located a platform rotating mechanism 42 which can also be controlled from the control panel 22.

The carriage 12 additionally includes a carriage drive mechanism and carriage steering mechanism shown schematically by reference numerals 44 and 46. These elements may be located differently than schematically shown on the vehicle 12, but are also under operator control at the control panel 22.

Figure 2:
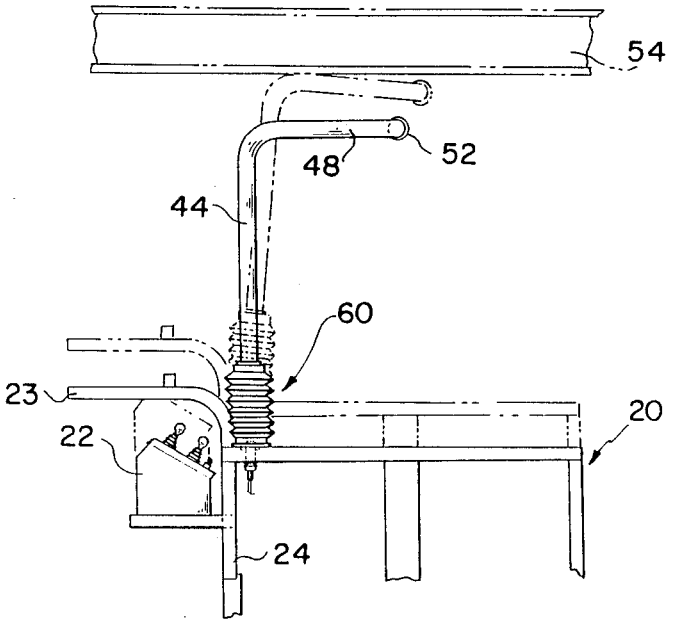
FIG. 2 is a partial side elevational view generally illustrative of the operation of the guard bar assembly located on the upper work platform or control box as shown in FIG. 1.
Figure 3:
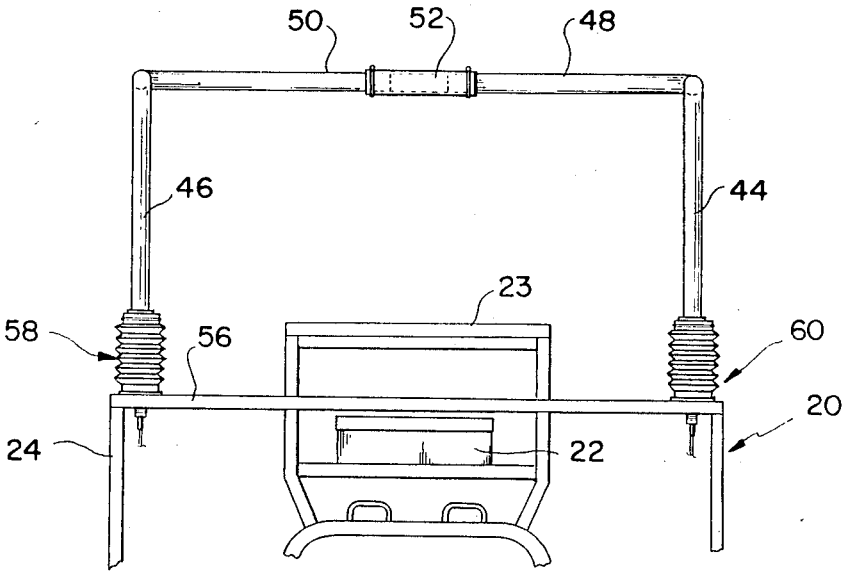
FIG. 3 is a front elevational view further illustrative of the guard bar assembly shown in FIG. 2.

This now leads to a consideration of FIGS. 2 and 3 where reference numerals 44 and 46 designate a pair of elongated bar members of an overhead impact guard assembly. The members 44 and 46 have a generally circular cross section and are mounted in a generally vertical orientation but bend into generally horizontal upper end sections 48 and 50. The end sections 48 and 50 are connected together by means of a flexible coupling 52. As shown in FIG. 2, the end sections 48 and 50 are adapted to contact an overhead obstruction 52 and be moved off center in any direction thereby, such as indicated by the phantom representation thereof. The results of such action will become evident as this detailed description proceeds. The lower portions of the guard bar members 44 and 46 are attached to a cross bar member 56 of the upper control box rail or frame 24. Attachment to the cross bar member 56 is by means of respective identical support mounts 58 and 60, the details of which are shown in FIG. 4.

Figure 4:
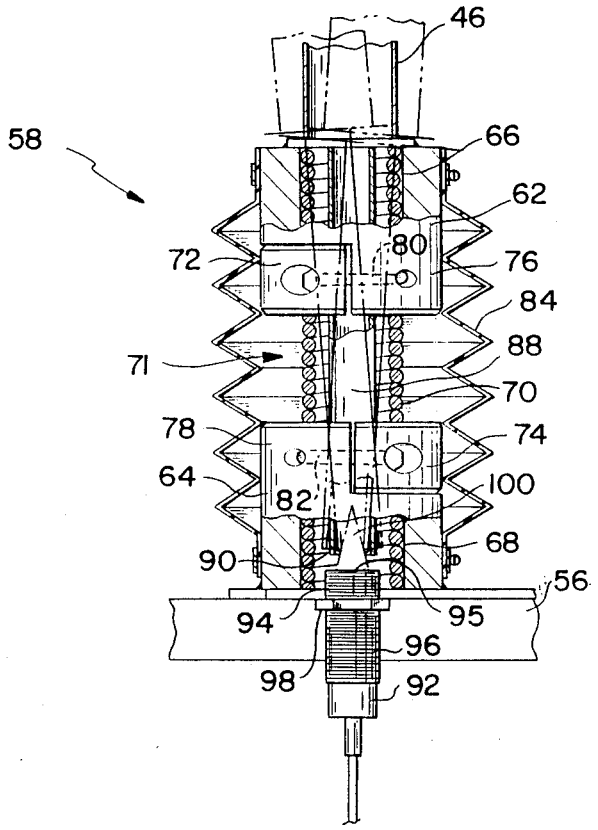
FIG. 4 is an enlarged partial cutaway view further illustrative of one of the movable guard bar mounts shown in FIGS. 2 and 3.

Referring now to FIG. 4, one of the support assemblies 58, for example, is shown comprised of a pair of generally cylindrical clamp members 62 and 64 having circular bores 66 and 68 for receiving an elongated coiled spring 70 of constant diameter therethrough. Lower clamp 64 is rigidly connected to cross bar member 56 and upper clamp 62 is rigidly connected to the bottom of a respective guard bar member 44 and 46. A flex region 71 of the spring 70 exists between the upper and lower clamp members 62 and 64. Both clamp members additionally include a respective split movable end segment 72 and 74 which is adapted to be tightened or loosened against an opposing fixed end segment 76 and 78 by means of a threaded bolt 80 and 82, to tightly secure the ends of spring 70 in the respective bores 66 and 68. A bellows type of dust cover 84 is shown connected between the clamps 62 and 64; however, the separation distance therebetween can be varied by raising or lowering the upper clamp 62 around the spring 70. This has the effect of varying the stiffness or flex provided by the spring 70 since the effective length of the spring in the flex region 71 is being shortened or lengthened. The foot pounds of force required to move the overhead impact guard assembly off vertical can be reduced by increasing the length of the spring in the flex region 71.

Further as shown in FIG. 4, the guide bar member 46, as well as bar member 44, terminates in an elongated tubular end section 88 of reduced diameter which fits down inside the bore of the spring member 70. The flat hollow end 90 of end section 88 is positioned directly above a magnetic induction proximity sensor 92 which projects through a threaded hole 94 formed in the cross bar member 56 and into the bores of the spring 70 and clamp 64. The proximity sensor 92 consists of a well known device which is manufactured and marketed by Peperel & Fuchs, Inc. under part No. NJ10-30GK-E2-Y11312 and includes a threaded outer sleeve 96 which is held in place by a nut 98. Sensor 92, moreover, comprises a switch type element which opens and closes in response to metal affecting a localized magnetic field pattern 100 generated thereby. It is understood that other types of switches can be used.

Accordingly, when the guard bar member 46 and/or 44 is moved off vertical center, such as shown in FIG. 2 and FIG. 4, where the upper control box 20 is raised, causing the horizontal guard bar sections 48, 50 to strike the obstruction 54, the spring flex region 71 and the small tubular end section 88 tilt as shown in the phantom lines. This in turn causes a change in the steady state magnetic field 100. In its normal operating state, the proximity switch 92 is in a closed circuit condition; however, when it is activated by a change in the magnetic field 100, the switch 92 will exhibit an "open circuit" condition. The amount by which the switch 92 extends into the bore of spring element 70 towards the lower end 90 of the tubular member 88 controls the sensitivity of the proximity switch 92. It can be readily observed that the closer that the forward end 95 of the sensor switch 92 is to the end 90 of the tube 88, the more sensitive the sensor switch 92 becomes to movement of tube 88 off vertical center, while a retraction away therefrom makes the sensor less sensitive.

Figure 5:
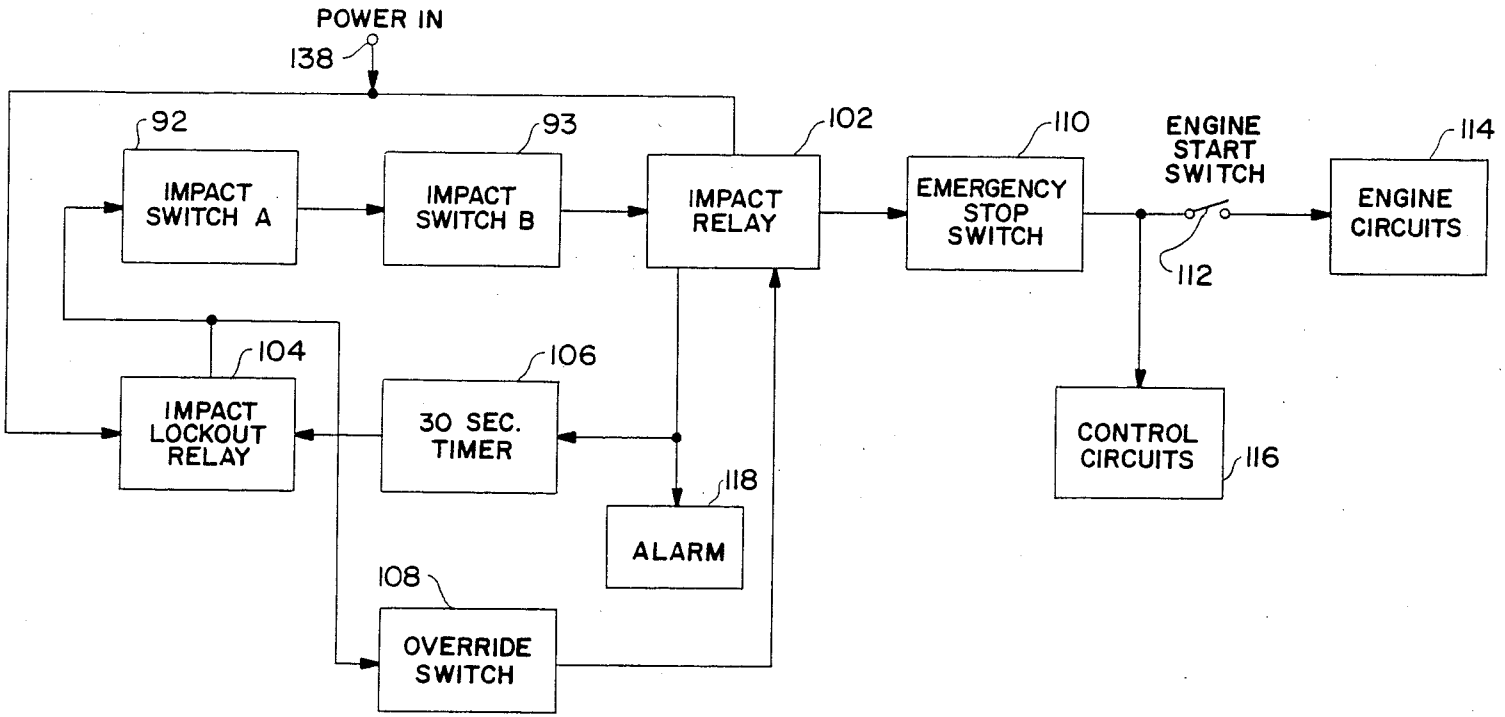
FIG. 5 is an electrical block diagram illustrative of a preferred embodiment of the electrical deactivator circuit forming a portion of the subject invention in combination with the guard bar assembly shown in FIGS. 2 and 3.
Figure 6:
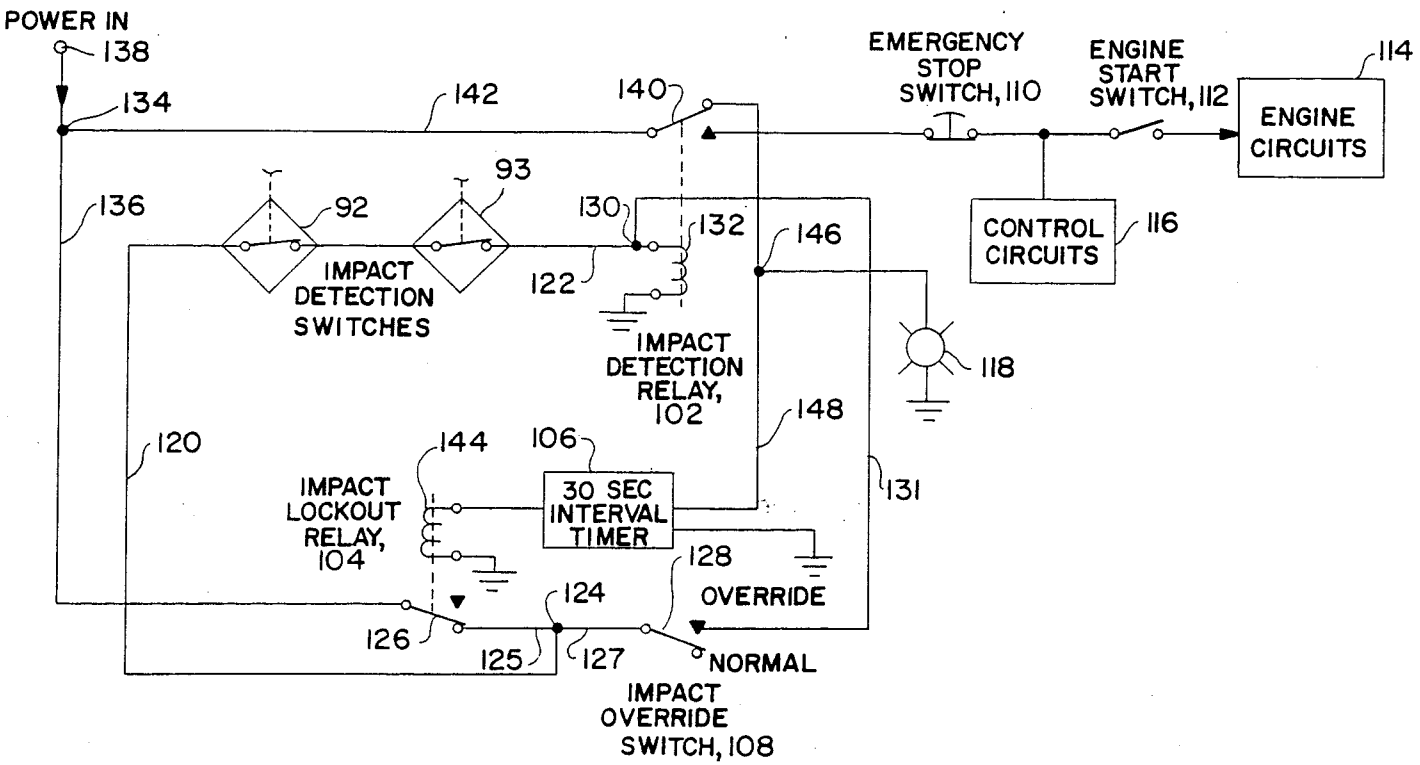
FIG. 6 is an electrical schematic diagram further illustrative of the deactivator circuit shown in FIG. 5.

This now leads to the electrical circuitry shown in FIGS. 5 and 6. There a pair of identical inductive proximity sensor switches 92 and 93, one of which is shown in FIG. 4, are connected in series between an impact detection relay 102, an impact lock out relay 104, a 30 sec. interval timer 106, and an impact override switch 108. The impact relay further couples to an emergency stop switch 110 which is positioned between an engine start switch 112 connected in series to electrical circuits 114 required to operate an internal combustion engine, and electrical control circuits 116 effecting operation of the control panel 22 to control the movement and manipulation of the carriage, the boom and upper control box. An alarm device 118 comprising an indicator light is also coupled to and energized through the impact relay 102.

As further illustrated in FIG. 6, the two inductive proximity type impact detection switches 92 and 93 which are located in the overhead guard bar support assemblies 58 and 60 (FIG. 3) are connected in series between circuit leads 120 and 122. Circuit lead 120 connects to a circuit node 124 which connects to a set of relay contacts 126 of the impact lock out relay 104 via circuit lead 125 and the switch contacts 128 of the impact override switch 108 via circuit lead 127. Circuit lead 122 connects to circuit node 130 which connects to the relay coil 132 of the impact detection relay 102 and the contacts 128 of the impact override switch 108. The set of relay contacts 126 of the impact lock out relay 104 additionally connects to circuit node 134 by means of circuit lead 136 for receiving input power from a DC source, not shown, coupled to terminal 138. The input power is also coupled to the set of relay contacts 140 of the impact detection relay 102 by way of circuit lead 142 connected to circuit node 134. The relay contacts 140 are also coupled to the 30 sec. interval timer 106 which in turn is coupled to the relay coil 144 of the impact lock out relay 104. The connection between relay contacts 140 and the timer 106 is by means of circuit node 146 and circuit lead 148. The alarm indicator light 118, or other type of warning device, is also connected to the set of relay contacts 140 at circuit node 146 as shown. Further, the set of relay contacts 140 couple directly to the emergency stop switch 110 which is interposed between the engine start switch 112 and the electrical control circuits 116 in control panel 22 that control all movement functions.

The operation of the electrical deactivation circuitry as depicted in FIGS. 5 and 6 will best be understood with reference to FIG. 6. Initially, at start up the emergency stop switch 110 is closed and DC power is applied to terminal 138. The circuit goes through a 30 sec. start up cycle, after which, if no faults are present, the engine can be started by closing the engine start switch 112. Accordingly, power appears on both circuit leads 142 and 136. The power appearing on circuit lead 142 passes through the normally closed contacts 140 where it is applied to the 30 sec. interval timer 106 via circuit lead 148 which energizes and in turn energizes the relay coil 144 of the impact lock out relay 104, causing the switch contacts 126 to open. Although power initially appears on circuit lead 136, the pull-in delay of the lock out relay 104 is shorter than the combined delay of the impact detection inductive proximity sensors 92 and 93 and the impact detection relay coil 132. During this 30 second time interval, alarm indicator light 118 is on.

After a 30 sec. time interval, the impact lock out relay coil 144 will become deenergized, causing the open relay contacts 126 to again close. This then couples DC power to circuit lead 120 which thereby applies power to the impact detection proximity sensor switches 92 and 93 and also energize the relay coil 132, causing the relay contacts 140 to couple power on circuit lead 142 to the engine start switch 112 and the control circuits 116 through the closed emergency stop switch 110. Alarm indicator light 118 goes off.

If either of the overhead guard bar members 44 or 46 (FIG. 3) are moved by any external force, e.g. striking an overhead obstruction, the appropriate impact detection proximity switch(s) 92, 93, will detect its magnetic field disturbance and go open circuit. When either or both of the switches 92 or 93 open, the relay coil 132 of the impact detection relay 102, becomes deenergized causing the relay contacts 140 to remove power from the movement control circuits 116 in the control panel 22, to again energize the 30 sec. timer 106, which in turn causes the impact lock out relay 104 to become energized and produce a 30 sec. lock out of normal operation, and illumination of alarm indicator light 118.

After a 30 sec. interval, which is a stop and think interval, the timer 106 times out and deenergizes the coil 144 of the impact lock out relay 104 to reapply power to the circuit node 124, which is common to the impact detection switches 92 and 93 as well as the impact override switch 108 connected to circuit lead 127. Thereafter, the contacts 128 of the override switch 108 can be manually closed to override the fault and apply power to the engine start switch 112 and control circuit 116 by energizing the impact detection relay coil 132 via circuit lead 131. This again causes the relay contacts 140 to connect circuit lead 142 to the emergency stop switch 110 interposed between the engine start switch 112 and the machine movement control circuits 116. In this manner, control can be obtained to move the boom 14 and/or carriage 12 away from the obstruction 54, for example, so that the system can return to normal, whereupon the impact detection switches 92 and 93 will return to their respective closed circuit conditions. It should be noted that the warning or alarm light 118 will be energized initially, during any thirty second lock out interval, or during a condition where an obstruction is causing either of the switches 92 or 93 to open.

Thus what has been shown and described is an overhead impact sensing system which is relatively simple yet extremely reliable to inhibit operation of an aerial work platform when a overhead guard bar strikes or contacts an external object or obstruction.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are herein meant to be included.

We claim:

1. A system for deactivating a movable work platform when the platform comes in relatively close proximity to an obstruction, comprising:

means on said platform for sensing the obstruction and changing operating states from a first operating state to a second operating state; and electrical circuit means responsive to the first operating state of said sensing means for enabling operation of said work platform following a predetermined time delay, for disabling operation of said work platform in response to said second operating state, and for thereafter overriding the disabled operation following another predetermined time delay in order to move the platform away from said obstruction and reestablish said first operating state.

2. The system as defined by claim 1 wherein both said predetermined time delays comprise substantially equal time delays.

3. The system as defined by claim 1 wherein said movable work platform comprises an aerial work platform including an upper work platform and wherein said means for sensing the obstruction comprises an overhead guard assembly mounted on the upper work platform.

4. The system as defined by claim 3 wherein said overhead guard assembly comprises two separately movable bar members and a respective pair of magnetic induction type proximity switches mounted on said upper work platform and being responsive to movement of the respective bar members to change from said first operating state to said second operating state.

5. The system as defined by claim 1 wherein said movable work platform comprises an aerial work platform and said means for sensing the obstruction comprises an overhead guard assembly and inductive proximity sensor means mounted on said aerial work platform, said sensor means being responsive to movement of said overhead guard assembly, whereupon said sensor means changes from said first operating state to said second operating state upon sensing said obstruction.

6. The system as defined by claim 5 wherein said overhead guard assembly includes two separately movable bar members extending upward and overhead of an operator located on said work platform.

7. The system as defined by claim 6 wherein said proximity sensor means comprises a pair of magnetic induction proximity sensor switch means mounted adjacent like ends of said bar members.

8. The system as defined by claim 7 wherein said aerial work platform includes a frame and wherein said like ends of said bar members are located in respective movable support means mounted on said frame.

9. The system as defined by claim 8 wherein each said movable support means comprise spring loaded support means including an elongated coil spring of substantially constant diameter, a pair of clamps engaging opposite end portions of said spring with one clamp being fixedly attached to said frame and the other clamp receiving said end of the respective bar member, the distance between said clamps further being adjustable to vary the stiffness of said spring in the region between said clamps.

10. The system as defined by claim 9 wherein said end of both bar members includes an end portion--of reduced size which fits down inside an upper portion of said elongated coil spring a predetermined distance for being sensed by a respective magnetic induction proximity sensor switch.

11. The system as defined by claim 10 wherein each said magnetic induction proximity sensor- is positioned in substantial alignment with and below said end portion of a respective bar member

12. The system as defined by claim 11 wherein said magnetic induction proximity sensor is adjustably mounted on said frame to project through a lower end portion of a respective elongated coil spring to sense movement of said end portion of said bar member so as to vary the sensitivity of said sensor to off-center movement of said bar member, said off-center movement causing said sensor to change from said first operating state to said second operating state thereby.

13. The system as defined by claim 7 wherein opposite like ends of said bar members project toward one another and further including a flexible coupling therebetween.

14. The system as defined by claim 13 wherein said opposite ends of said bar members include generally vertical bar sections which bend into generally horizontal end sections which terminate at said flexible coupling.

15. The system as defined by claim 1 wherein said first operating state comprises a closed circuit state and said second operating state comprises an open circuit state.

16. The system as defined by claim 15 wherein, said means for sensing includes proximity switches connected in series and further comprising:

switch means for applying electrical power to said work platform;

interval timer means;

first and second relays having respective relay coils and a set of relay contacts including normally open and normally closed contact pairs;

an override switch including a pair of normally open switch contacts;

circuit means coupling said series connected proximity switches between the relay coil of said first relay and one side of the normally closed contact pair of said second relay;

circuit means coupling electrical power to the other side of the normally closed contact pair of said second relay and to one side of the normally closed contact pair of said first relay;

circuit means coupling the normally open contact pair of said first relay to said switch means for applying electrical power;

circuit means coupling the normally closed contact pair of said first relay to one side of said interval timer means;

circuit means coupling the other side of said interval timer means to the relay coil of said second relay; and circuit means coupling said pair of normally open switch contacts of said override switch to the relay coil of said first relay.

17. The system as defined by claim 16 wherein said interval timer means operates to initially provide closed circuit therethrough when energized by said first relay and thereafter providing an open circuit after said predetermined time delay to decouple the relay coil of said second relay from said normally closed contact pair of said first relay.

18. The system as defined by claim 17 wherein said time delay comprises a time delay of substantially 30 sec.

19. The system as defined by claim 16 wherein said work platform comprises an aerial work platform including an upper work platform and having control circuit means and engine circuit means thereon, and wherein said switch means for applying electrical power to operate said aerial work platform includes an emergency stop switch connected between said normally open contact pair of said first relay and said control circuit means and engine circuit means.

20. The system as defined by claim 19 and additionally including alarm indicator means coupled to said circuit means coupling one side of said interval timer means to said normally closed contact pair of said first relay.

* * * * *